US007419463B2

(12) United States Patent
Aagaard et al.

(10) Patent No.: US 7,419,463 B2
(45) Date of Patent: Sep. 2, 2008

(54) CENTRIFUGE COMPRISING A PLURALITY OF CENTRIFUGAL DRUMS PROVIDED WITH PACKETS OF DISKS

(75) Inventors: Poul-Erik Aagaard, Sporup (DK); Klaus-Dieter Bröker, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/563,981

(22) PCT Filed: Jul. 8, 2004

(86) PCT No.: PCT/EP2004/007518

§ 371 (c)(1),
(2), (4) Date: Aug. 14, 2007

(87) PCT Pub. No.: WO2005/007296

PCT Pub. Date: Jan. 27, 2005

(65) Prior Publication Data

US 2008/0045396 A1 Feb. 21, 2008

(30) Foreign Application Priority Data

Jul. 11, 2003 (DE) ..... 103 31 732

(51) Int. Cl.
*B04B 1/08* (2006.01)
*B04B 5/02* (2006.01)

(52) U.S. Cl. ..... 494/34; 494/70

(58) Field of Classification Search ..... 494/31, 494/33, 34, 68–70
See application file for complete search history.

(56) References Cited

U.S. PATENT DOCUMENTS

| | | | | |
|---|---|---|---|---|
| 3,311,295 | A | 3/1967 | Rubissow | |
| 4,228,950 | A | 10/1980 | Ito | |
| 4,874,358 | A * | 10/1989 | Brimhall et al. | |
| 5,163,895 | A | 11/1992 | Titus | |
| 6,716,152 | B2 * | 4/2004 | Wood | 494/33 |
| 2002/0016245 | A1 | 2/2002 | Zettier | |

FOREIGN PATENT DOCUMENTS

| | | |
|---|---|---|
| BE | 703 747 | 9/1967 |
| CH | 377 723 | 5/1964 |
| DE | 78491 | 4/1892 |
| DE | 106703 | 12/1898 |
| DE | 1 432 853 | 4/1972 |
| DE | 31 31 329 A1 | 4/1982 |
| DE | 40 13 388 A1 | 10/1991 |
| DE | 200 10 743 U1 | 10/2000 |
| FR | 558915 | 9/1923 |
| GB | 2 082 009 A1 | 2/1982 |
| SU | 1556761 A1 | 4/1990 |
| WO | WO 2005007296 A1 * | 1/2005 |

* cited by examiner

*Primary Examiner*—Charles E Cooley
(74) *Attorney, Agent, or Firm*—Barnes & Thornburg LLP

(57) ABSTRACT

A centrifuge includes at least two centrifugal drums, each drum including a disc stack and each drum being rotatable about first and second axes of rotation. The first axis of rotation extends through a center of gravity of and is within each drum. The second axis of rotation is situated outside each drum.

18 Claims, 2 Drawing Sheets

CENTRIFUGE COMPRISING A PLURALITY OF CENTRIFUGAL DRUMS PROVIDED WITH PACKETS OF DISKS

BACKGROUND AND SUMMARY

The present disclosure relates to a centrifuge with a rotatable centrifugal drum having a stack of discs.

Separators of this type are known in many different embodiments, for example, from German Patent Document DE 200 10 743 U1.

The present disclosure relates to an improvement on this state of the art such that separators are created which have at least partially improved characteristics and new usage possibilities.

The present disclosure relates to a new type of centrifuge which has many different advantages in comparison with the state of the art.

The present disclosure relates to a centrifuge having at least two centrifugal drums which can respectively be rotated about two axes of rotation. One of the axes of rotation extends through the center of gravity of the centrifugal drums such that the axis of rotation is situated inside each of the at least two drum(s). An additional axis of rotation is situated outside the centrifugal drums. The two axes of rotation extending through the center of gravity may be aligned or may be parallel to one another in a plane. A disc stack is in each of the drums.

A separator or centrifuge with at least two drums which each rotate about two axes of rotation and which each have a stack of discs results in new effects in the interior of the centrifugal drums which can be utilized, for example, for optimizing the solids discharge.

From the state of the art, filter centrifuges are known, for example, which have two filter drums (German Patent Document DE 3131329 A1).

German Patent Document DE 3 092 579 also shows an evacuating system for open drums which can be rotated about an axis of symmetry and, during the evacuation, are tilted about a second axis extending through the drum.

German Patent Document DE 1 432 853 OS shows a method and a device for separating substances by gyrofugation. In such a case one drum is rotated about its axis of symmetry and is moved about another axis on a circular ring, which axis is inclined by approximately 45° with respect to the axis of symmetry.

Concerning the state of the art, German Patent Document DE 40 13 388 A1 and Belgian Patent Document BE 703747 are also cited which are more remote.

However, separators with more than one drum, with each drum having a disc stack and the drums being rotatable about more than one axis of rotation are not known to be disclosed or suggested in the state of the art.

According to the present disclosure, a centrifuge includes at least two centrifugal drums. One of the axes of rotation is situated inside the at least two centrifugal drums, and the other axis of rotation is situated outside the centrifugal drums. Thus, a centrifuge is obtained which can more easily be balanced than a centrifuge with only one centrifugal drum because the additional axis of rotation of the centrifugal drum is situated outside the centrifugal drum.

The present disclosure can be implemented in a compact and uncomplicated manner such that the first axes of rotation of the drums are each situated inside the drums and are congruent with an axis of symmetry of the drums. The second axis of rotation perpendicularly crosses the first axes of rotation. This arrangement can be implemented, for example, by a dumbbell-type distribution of the drums, the axis of symmetry of the drums in each case representing the first axis of rotation and the two drums being rotated in a dumbbell-type manner about the second axis of rotation. In this case, the solids are transported to the outside as a result of the rotation of the two drums about the joint second axis of rotation, without requiring auxiliary devices for this purpose. The disc stacks have an additional clarifying effect because they rotate about the first axis of rotation. As a result of the rotation about the second axis outside the disc stack, which is superposed on the rotational speed of the first axis, flow behaviors are also obtained which differ from those of the state of the art.

The at least two centrifugal drums have a double-conical construction, including two mutually oppositely oriented conical sections each being constructed at a respective end area, of the drum. One such end area is located adjacent to the second axis of rotation and the other such end area is located and distanced further away relative to the second axis of rotation. The two conical sections of each centrifugal drum are mutually connected by cylindrical sections.

A disc stack with conical discs and rising ducts is arranged concentrically with respect to the inflow pipe in the centrifugal drums. Solids from the feed or centrifugal material are separated in the disc stack and collected in the solids space (cylindrical) of the centrifugal drum. As a result of the rotation about the second axis A2, the solids are then transported to the outside. As a result of this construction, it becomes possible to convey the solids by rotation of the drums about the joint second axis of rotation completely automatically to the outside. A use of the system is conceivable for the purpose of clarification (solid/liquid) and/or of separation (liquid/liquid). As a result of the rotation about the first axis, the effect of the disc stacks is the same as in a normal separator. However the disc stacks can also have discs at the top. The rotational speed at the first axis corresponds to that of a separator.

Since it becomes possible to transport the solids without additional mechanisms out of the drum, in comparison to decanters, this means that neither a planetary gear nor a screw are to be provided for discharging the solids. This also eliminates wear.

In addition, because of the disc stack in the drums, an almost arbitrary clarification surface can be implemented. Mechanical limits as a result of natural frequencies can largely be avoided. It also becomes possible to mount self-cleaning sieve inserts. The energy requirement is relatively low because the solids outlet is situated in the center of the axis of rotation. By an open inlet with centrifugal support, overflowing can be avoided. However, not only open but also closed systems, such as centripetal pumps or the like, are conceivable.

In comparison to known separators, no hydraulic drum system has to be provided for the evacuation. Also, the clogging of nozzles can be avoided because the nozzle diameter can be large in comparison to systems with many small nozzles, and the energy requirement for the solids discharge in the center of the main axis of rotation is low. Under certain circumstances, backwards-oriented nozzles are even conceivable if they do not also rotate about the first axis. This can be implemented, for example, by floating ring seals. If the nozzles are arranged on a machine frame which rotates only about the second axis of rotation, this again lowers energy requirements.

However, it should also be noted that it is conceivable to connect the centrifugal drums behind one another with respect to the flow path of the centrifugal material. And, for example, it is possible to use one of the centrifugal drums for a preclarification and another centrifugal drum for the fine clarification which follows.

Other aspects of the present disclosure will become apparent from the following descriptions when considered in conjunction with the accompanying drawings.

DETAILED DESCRIPTION

Figure 1:
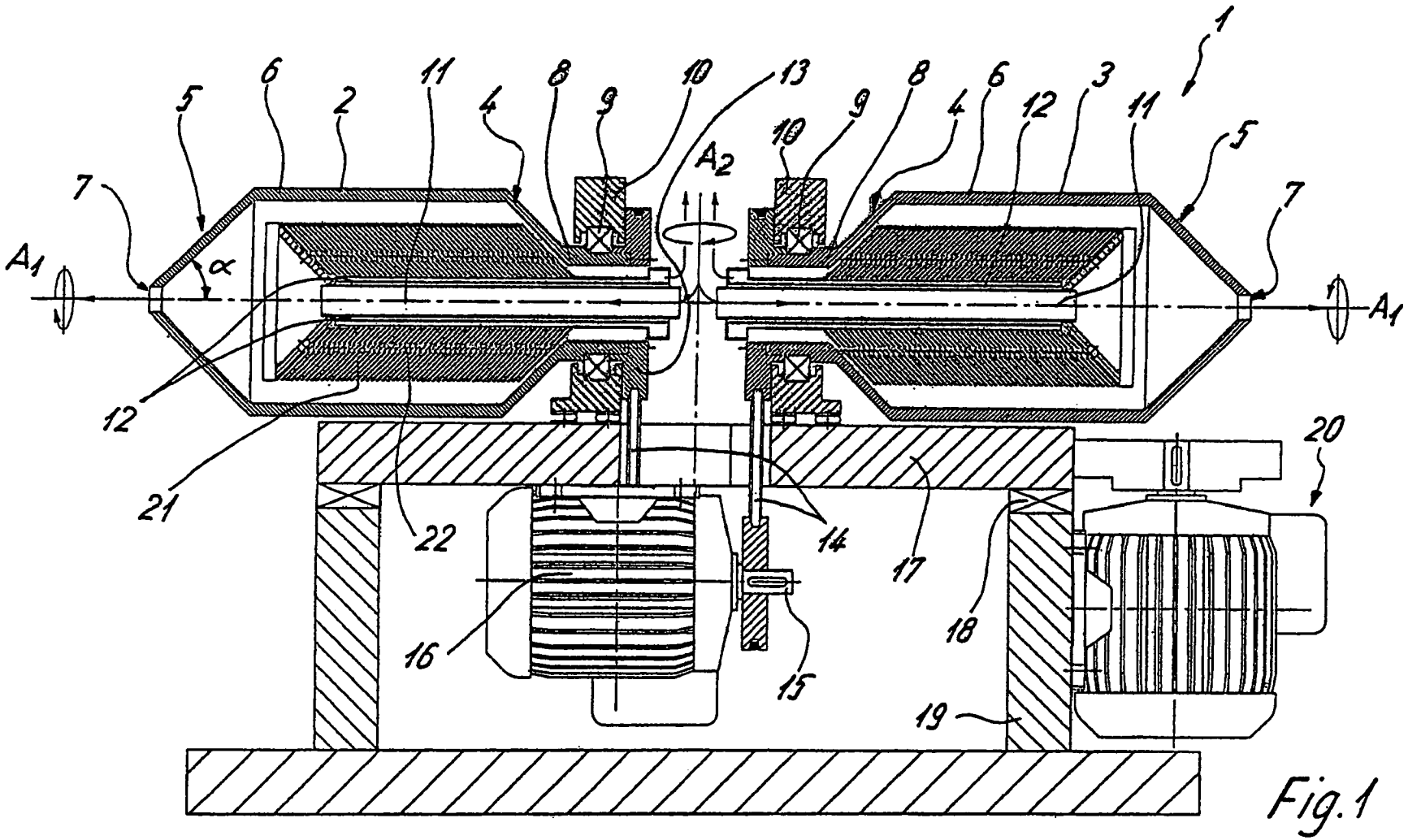
FIG. 1 is a sectional view of an embodiment of a centrifuge, according to the present disclosure.
Figure 2:
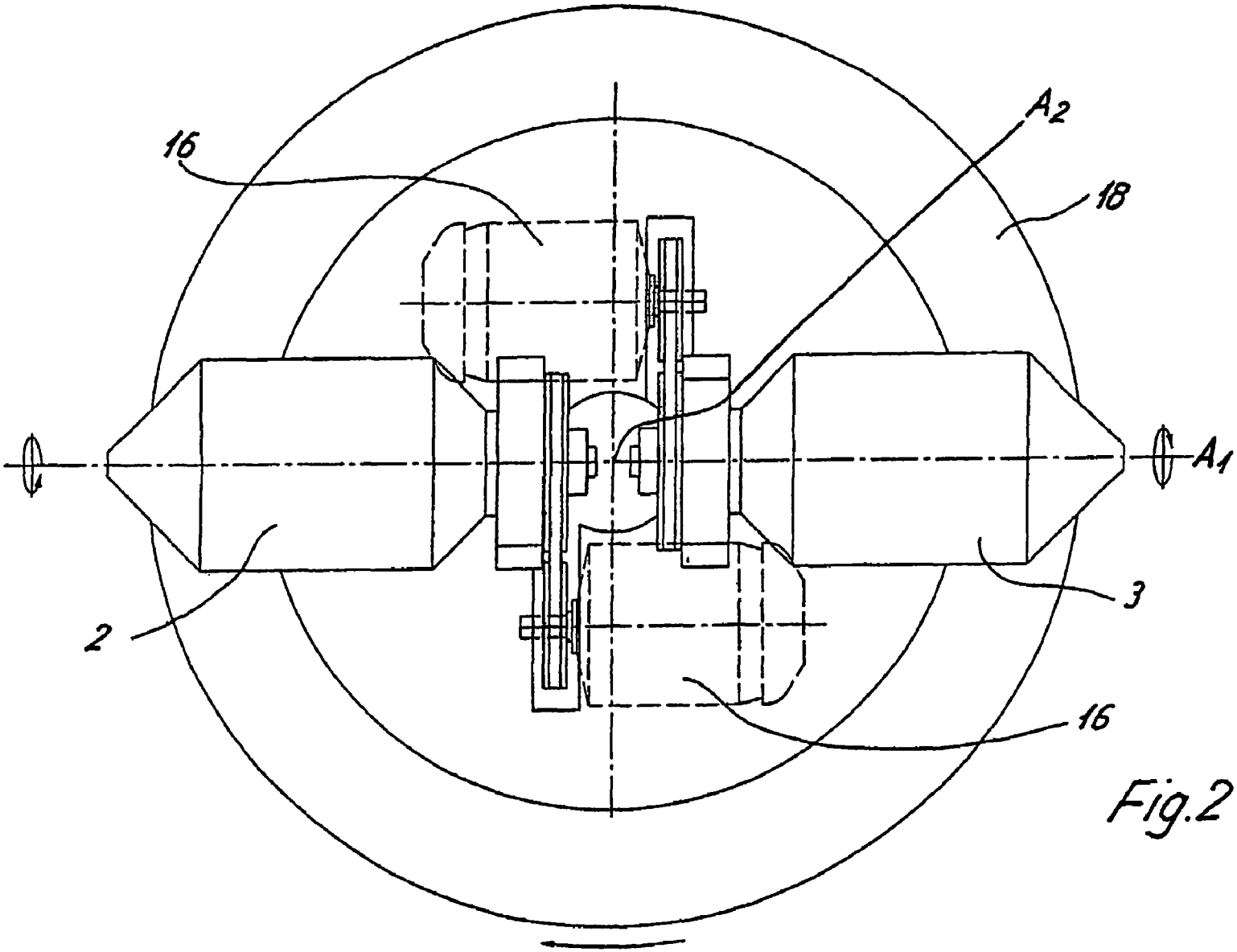
FIG. 2 is a top view of the embodiment of FIG. 1.

FIG. 1 illustrates a centrifuge 1 having two centrifugal drums 2, 3 which are each rotatable about a first axis of rotation A1, shown as a horizontal axis of rotation.

The first axes of rotation A1 extend through the centrifugal drums 2, 3, in each case as axes of symmetry in their center of gravity and are aligned here with one another. The centrifugal drums 2, 3 are arranged opposite one another. However, the first axes of rotation A1 do not have to be mutually aligned. They can also have a different mutual orientation, preferably a parallel mutual alignment (not shown).

Furthermore, the centrifugal drums 2, 3 can each also be rotated about a second axis of rotation A2, which here is shown situated outside the centrifugal drums 2, 3. The two centrifugal drums 2, 3 are rotated jointly "as a whole" about the second axis of rotation A2 situated outside the centrifugal drums 2, 3. The second axis of rotation A2 is in a joint center of gravity of the centrifugal drums 2, 3 which second axis of rotation A2 is situated perpendicular to the first axis of rotation A1 and crosses the latter.

Since, in the embodiment shown, the first axes of rotation A1 are mutually aligned, and the second axis of rotation A2 is the same for both centrifugal drums 2,3, the construction is simple and clear. Thus, a single driving device 20 is sufficient for the rotation of both centrifugal drums 2, 3 about the second axis of rotation A2.

The centrifugal drums 2, 3 have a double-conical construction, including two mutually oppositely oriented inner and outer conical sections 4, 5, respectively. Inner conical section 4 is constructed at end area 26 and outer conical section 5 is constructed at end area 28. End area 26 is located adjacent relative to the second axis of rotation A2 and end area 28 is located and distanced further away relative to the second axis of rotation A2. The conical sections 4, 5 are mutually connected by central cylindrical sections 6. In the area of sections 4, 5, 6, the centrifugal drums 2, 3 have or comprise a continuous basket shell 24.

At the outside end areas 28 of the outer conical sections 5, discharge openings 7 or nozzles are constructed for a solids phase and are oriented concentrically to the first axis of rotation A1. Relative to the first axis of rotation A1, the outer conical sections 5 are each conically at an acute taperangle $\alpha$ (see FIG. 1). The angle of taper $\alpha$, with respect to the first axis of rotation A1, amounts to 60° or less, so that wear effects as a result of solids exiting from the nozzles 7 on the drum basket shell 24 are largely avoided. This angle $\alpha$ is selected such that the solids can slide off on this angle $\alpha$.

In the direction of the second axis of rotation A2, the inner conical sections 4 are followed by cylindrical attachments 8 which are rotatably disposed by bearing systems 9, for example, by suitable ball bearings in carrier elements 10 which absorb axial and radial forces. It is also conceivable to provide additional bearing systems (not shown) in an outer area of the centrifugal drums, for example, following the conical areas 5 on cylindrical attachments or the like (not shown).

A centric feeding pipe 11 for feeding centrifugal material extends through the cylindrical attachments 8 and, for example, discharge ducts 12 arranged concentrically and/or parallel to pipe 11, for discharging a lighter phase, such as a liquid phase. Ducts 12 may be connected toward the interior, with respect to the second axis of rotation A2, with additional inlet and discharge pipes (not shown) which may go through the second axis of rotation A2. The function of the feeding pipe 11 and the discharge ducts 12 can also be reversed, with a corresponding modification of connections. It is also conceivable to connect the two centrifugal drums 2, 3 fluidically behind one another.

Toward an interior of the arrangement of drum 2, 3, pulleys 13 are placed on the cylindrical attachments 8, which pulleys 13 are connected by driving belts 14 with output shafts 15 of first driving devices 16. Driving devices 16 may be electric motors or hydraulic motors, which may be arranged parallel to the centrifugal drums 2, 3 on opposite sides of the centrifugal drums 2, 3 in order to implement an arrangement which is as free of imbalances as possible. Instead of a belt drive 14, such as flat belts, V-belts or toothed belts, chain drives or direct-acting transmissions, such as toothed gearings, or the like, are conceivable.

The two driving devices 16 as well as the carrier elements 10, which carry the centrifugal drums 2, 3, are arranged on a rotatable carrier-type ring 17, through whose center the second axis of rotation A2 extends. The centrifugal drums 2, 3 are arranged above ring 17 and the first driving devices 16 are situated below the ring 17. In addition, it is conceivable to arrange the centrifugal drums 2, 3 between an upper and a lower ring (not shown) or to arrange the driving devices also above the ring 17 (not shown.) The two centrifugal drums 2, 3 may also have a joint driving device 16 for driving the centrifugal drums 2, 3 about the first axis of rotation A1. For example, a driving motor with two pulleys on a joint output shaft or the like (not shown).

By use of bearings 18, the horizontally aligned ring 17 is rotatably disposed on a base structure 19 and can be rotated by a second driving device 20 on the base structure 19. The bearing 18 absorbs axial as well as radial forces and can also be implemented in a different fashion.

A disc stack 21 having conical discs is arranged concentrically with respect to the feeding pipe 11 in the two centrifugal drums 2, 3, which disc stack 21 can be provided with rising ducts 22 and can have a construction analogous to disc stacks of separators.

During an operation, the two centrifugal drums 2, 3 rotate at a relatively high first rotational speed about the first axis of rotation A1, as compared to a rotational speed about the second axis of rotation A2. In this manner, a circumferential speed about the first axis of rotation A1 at an outer drum diameter can be reached, which is known from decanters or, under certain circumstances, even from separators. For example, such a first rotational speed may be a circumferential speed of more than 80 m/sec. Whereas, the two centrifugal drums 2,3 rotate about the second axis of rotation A2 at a relatively lower circumferential speed, such as at a subcritical operation speed. The term "subcritical operation" indicates a rotational speed below the first resonance frequency of the separator.

Centrifugal material in each case is fed through the feeding pipe 11 and enters into the centrifugal drums 2, 3, where liquids of different densities collect on different radii and are discharged through one or more discharge pipes or centripetal pumps, or the like. According to FIG. 1, only one liquid phase is discharged in each centrifugal drum 2, 3.

The solid phases collect on an inner circumference of the centrifugal drums 2, 3, and, as a result of the rotation of the centrifugal drums 2, 3 about the second axis of rotation A2, move away from the latter toward outer conical sections 5 to the discharge openings 7. The solid phases move out of the centrifugal drums 2, 3 and are collected (not shown), for example, in an outer ring-type collecting device or the like (not shown).

It is noted here that an almost "automatic" solids discharge is implemented through the discharge opening 7 in the outer conical sections 5, without a requirement to provide auxiliary devices for the solids discharge, such as a screw, in the drums 2, 3. In contrast to separator drums, a clogging of the nozzles can also be avoided. Although additional centrifugal forces may act upon the centrifuge disclosed herein, by a suitable compensation and a suitable distribution of masses, particularly by a suitable arrangement of the driving motors and by mass-balancing weights (not shown), these centrifugal forces can be kept within comprehensible limits.

As a result of providing at least two centrifugal drums 2, 3, the capacity of each centrifuge is relatively large. It is even conceivable to arrange, instead of the two centrifuges shown herein, also three, four or more centrifuges evenly distributed around the second axis of rotation A2 on the circumference.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A centrifuge, comprising:

at least two centrifugal drums, each drum including a disc stack and each drum being rotatable about first and second axes of rotation;

the first axis of rotation extends through a center of gravity of and is within each drum, and the second axis of rotation is situated outside each drum; and wherein the centrifugal drums have a double-conical construction including two mutually oppositely oriented inner and outer conical sections, each of the conical sections being constructed at an end area of the centrifugal drums.

2. The centrifuge according to claim 1, wherein the axes of rotation extending through the center of gravity of each drum and are oriented either parallel to one another or are aligned with one another.

3. The centrifuge according to claim 1 wherein the centrifugal drums have a continuous basket shell.

4. The centrifuge according to claim 1, wherein a maximal rotational speed of the centrifugal drums about the first axis of rotation is higher than a maximal rotational speed about the second axis of rotation.

5. The centrifuge according to claim 1, wherein the centrifugal drums are arranged opposite one another, and the first axes of rotation of the centrifugal drums are aligned with one another.

6. The centrifuge according to claim 1, wherein the second axis of rotation is arranged perpendicular to the first axis of rotation of each drum and crosses each first axis of rotation.

7. The centrifugal drum according to claim 1, wherein the inner and outer conical sections of each centrifugal drum are mutually connected by central cylindrical sections.

8. The centrifuge according to claim 1, wherein relative to the first axis of rotation, the outer conical sections are each constructed at an acute angle with respect to the first axis of rotation, the angle amounting to 60° or less.

9. The centrifuge according to claim 1, wherein the disc stack is arranged concentrically with respect to a feeding pipe in each of the centrifugal drums.

10. The centrifuge according to claim 1 wherein the disc stack includes rising ducts.

11. The centrifuge according to claim 1, wherein at an end of the outer conical sections, discharge openings for a solid phase are constructed and oriented concentrically with respect to the first axis of rotation.

12. The centrifuge according to claim 1, wherein the centrifugal drums have a common driving device for driving the centrifugal drums about the first axis of rotation.

13. The centrifuge according to claim 1, wherein the at least two centrifugal drums are connected behind one another with respect to a flow path of centrifugal material.

14. The centrifuge according to claim 1, wherein each drum includes cylindrical attachments shaped onto the inner conical sections toward the second axis of rotation, which attachments are disposed in carrier elements connected by bearings.

15. The centrifuge according to claim 14, wherein each drum includes a centric feeding pipe for centrifugal material and also includes discharge ducts extending through the cylindrical attachments.

16. A centrifuge, comprising:

at least two centrifugal drums, each drum including a disc stack and each drum being rotatable about first and second axes of rotation;

the first axis of rotation extends through a center of gravity of and is within each drum, and the second axis of rotation is situated outside each drum;

wherein each centrifugal drum includes a first driving device for driving the centrifugal drum about the first axis of rotation; and wherein the centrifugal drums and their driving devices are arranged on at least one rotatable ring.

17. The centrifuge according to claim 16, wherein the at least one rotatable ring is horizontally aligned and is rotatably disposed by bearings on a base structure.

18. The centrifuge according to claim 16, wherein the at least one rotatable ring is rotated on a base structure by a second driving device.

* * * * *